US007392898B2

(12) United States Patent
Bullock et al.

(10) Patent No.: US 7,392,898 B2
(45) Date of Patent: Jul. 1, 2008

(54) PACKAGING PROCESS FOR GRANULAR MATERIAL AND PACKAGE PRODUCED THEREBY

(75) Inventors: Donald Bullock, Etobicoke (CA); Dave Carlson, Brampton (CA); Peter Medeiros, Brampton (CA); Ljiljana Lukic, Maple (CA); Doreen Andrea, Brampton (CA); Gordon Jahn, Limehouse (CA)

(73) Assignee: Plant Products Co. Ltd., Brampton, Ontario (CA)

( * ) Notice: Subject to any disclaimer, the term of this patent is extended or adjusted under 35 U.S.C. 154(b) by 495 days.

(21) Appl. No.: 10/981,236

(22) Filed: Nov. 4, 2004

(65) Prior Publication Data

US 2005/0252794 A1 Nov. 17, 2005

Related U.S. Application Data

(60) Provisional application No. 60/570,230, filed on May 12, 2004.

(51) Int. Cl.
*B65D 25/08* (2006.01)

(52) U.S. Cl. ..... 206/221; 53/469; 53/474

(58) Field of Classification Search ..... 206/219, 206/221, 526; 53/467, 469, 474
See application file for complete search history.

(56) References Cited

U.S. PATENT DOCUMENTS

| | | | |
|---|---|---|---|
| 2,047,745 | A | 7/1936 | Poppe |
| 2,401,110 | A | 5/1946 | Rohdin |
| 3,891,138 | A | 6/1975 | Glas |
| 4,174,599 | A | 11/1979 | Callet et al. |
| 4,201,031 | A | 5/1980 | Wiles |
| 4,557,377 | A | 12/1985 | Maloney |
| 4,704,845 | A | 11/1987 | Bruno |
| 5,102,234 | A | 4/1992 | Levy |
| 5,210,993 | A | 5/1993 | van Boxtel |
| 5,337,539 | A | 8/1994 | Barton |
| 5,407,278 | A | 4/1995 | Beer |
| 5,819,509 | A | 10/1998 | McGregor et al. |
| 6,395,317 | B1 | 5/2002 | Singh et al. |
| 6,579,008 | B2 | 6/2003 | Price et al. |

*Primary Examiner*—David T Fidei
(74) *Attorney, Agent, or Firm*—Young Basile

(57) ABSTRACT

A packaging process is disclosed. The process comprises the step of providing a bag. The bag includes a plurality of flexible panels including a first panel, a second panel and a third panel, the plurality of panels being disposed in stacked relation to one another with the second panel between the first panel and the third panel, and connected to one another to form a first pocket between the first panel and the second panel and a second pocket between the second panel and the third panel. The process further comprises the steps of: filling the first pocket with a first fertilizer product and the second pocket with a second fertilizer product; and sealing the first pocket and sealing the second pocket. A package produced by the process is also disclosed.

20 Claims, 11 Drawing Sheets

PACKAGING PROCESS FOR GRANULAR MATERIAL AND PACKAGE PRODUCED THEREBY

FIELD OF THE INVENTION

The present invention relates to processes for packaging granular materials, such as water-soluble granular fertilizers for plants, and to packages containing water-soluble granular plant fertilizer. Throughout this disclosure, "granular" material should be understood to include grains, powders, crystals and/or prills. This application claims benefit of the filing date of and right of priority of U.S. Provisional Patent Application Ser. No. 60/570,230 filed May 12, 2004 under 35 USC § 119(e).

BACKGROUND OF THE INVENTION

Plant nutrients can be classified as primary plant nutrients (sources of nitrogen, phosphorus and potassium); secondary plant nutrients (sources of calcium, magnesium and sulfur); and micronutrients (such as copper, zinc, boron, iron, manganese, molybdenum and the like). Such nutrients are often made available for sale in the form of water-soluble granular fertilizers. The granular fertilizers can be dissolved in water and delivered to plants for uptake, such as occurs in greenhouse operations. Alternatively, they can be broadcast over a field, in which event, they will solubilize over time by exposure to rainfall and other precipitation, for uptake by nearby crops.

As is well known in the art, many granular fertilizers, and particularly those containing relatively high levels of the secondary plant nutrients calcium and/or magnesium, have a tendency to cake and clump when stored for any significant period of time. If this occurs, and the material is intended for broadcast spreading, it is necessary for the user to crush or otherwise break up the material prior to use. Even if the material is intended for dissolution, it is commonplace for a preparatory crushing operation to be employed, to speed solubilization. This is inconvenient, and can require users to possess crushing equipment.

To avoid the need for preparatory crushing operations, it is known for fertilizer manufacturers to provide the fertilizer in a two-part form, to enhance storage-stability.

For example, it is known for fertilizer manufacturers to provide a fertilizer first part, composed largely of primary plant nutrients and micronutrients, and a fertilizer second part, composed largely of secondary plant nutrients containing calcium and/or magnesium. Sometimes the first part and the second part are vended in separate bags, for mixing shortly prior to use. This "two-bag system" avoids the potential for clumping, since the calcium and/or magnesium compounds of the second part are isolated from the phosphorus-containing first part until use. However, this system increases the likelihood of misapplication. It is also known to package the second part in a bag which itself is contained in a bag which holds the first part. This "bag-in-bag system" renders misapplication relatively unlikely. However, this latter system is relatively inconvenient to use, since the user must open the outer bag; find, remove and open the inner bag; and mix the contents of the bags together prior to use. Additionally, production of bag-in-bag systems of the prior art is relatively labour intensive.

SUMMARY OF THE INVENTION

The present invention includes a process for packaging granular materials, such as water-soluble granular fertilizers for plants, and a package produced by such process. In the package, the water-soluble granular fertilizers are not highly susceptible to caking or clumping in normal storage conditions; the package itself is relatively convenient to use and less susceptible to misapplication than two-bag systems of the prior art.

The package comprises a plurality of flexible panels including a first panel, a second panel and a third panel. The plurality of panels are disposed in stacked relation to one another with the second panel between the first panel and the third panel, and are connected to one another to form a first sealed pocket between the first panel and the second panel and a second sealed pocket between the second panel and the third panel. A first fertilizer product is disposed in the first sealed pocket and a second fertilizer product is disposed in the second sealed pocket.

In the process, a bag is provided. The bag includes a plurality of flexible panels including a first panel, a second panel and a third panel. The plurality of panels are disposed in stacked relation to one another with the second panel between the first panel and the third panel, and are connected to one another to form a first pocket between the first panel and the second panel and a second pocket between the second panel and the third panel. The first pocket is filled with a first fertilizer product and the second pocket is filled with a second fertilizer product, and the first pocket and the second pocket are sealed.

BRIEF DESCRIPTION OF THE IMAGES

DETAILED DESCRIPTION

With general reference to FIGS. 1-18, a preferred embodiment of the process of the present invention is illustrated, as is the package produced thereby, which forms another preferred embodiment of the invention.

The process is for packaging respective supplies of two disparate granular materials.

The disparate granular materials comprise, respectively, first granular material and second granular material. The first granular material is a water-soluble first fertilizer product comprised primarily of primary plant nutrients and micronutrients and has a relatively high concentration of phosphorus and a relatively low concentration of calcium and magnesium. The first granular material can be in the form of grains, powders, crystals and/or prills. The second granular material is a water-soluble second fertilizer product comprised primarily of secondary plant nutrients and has a relatively low concentration of phosphorus and a relatively high concentration of calcium and/or magnesium. The second granular material can be in the form of grains, powders, crystals and/or prills.

Figure 1:
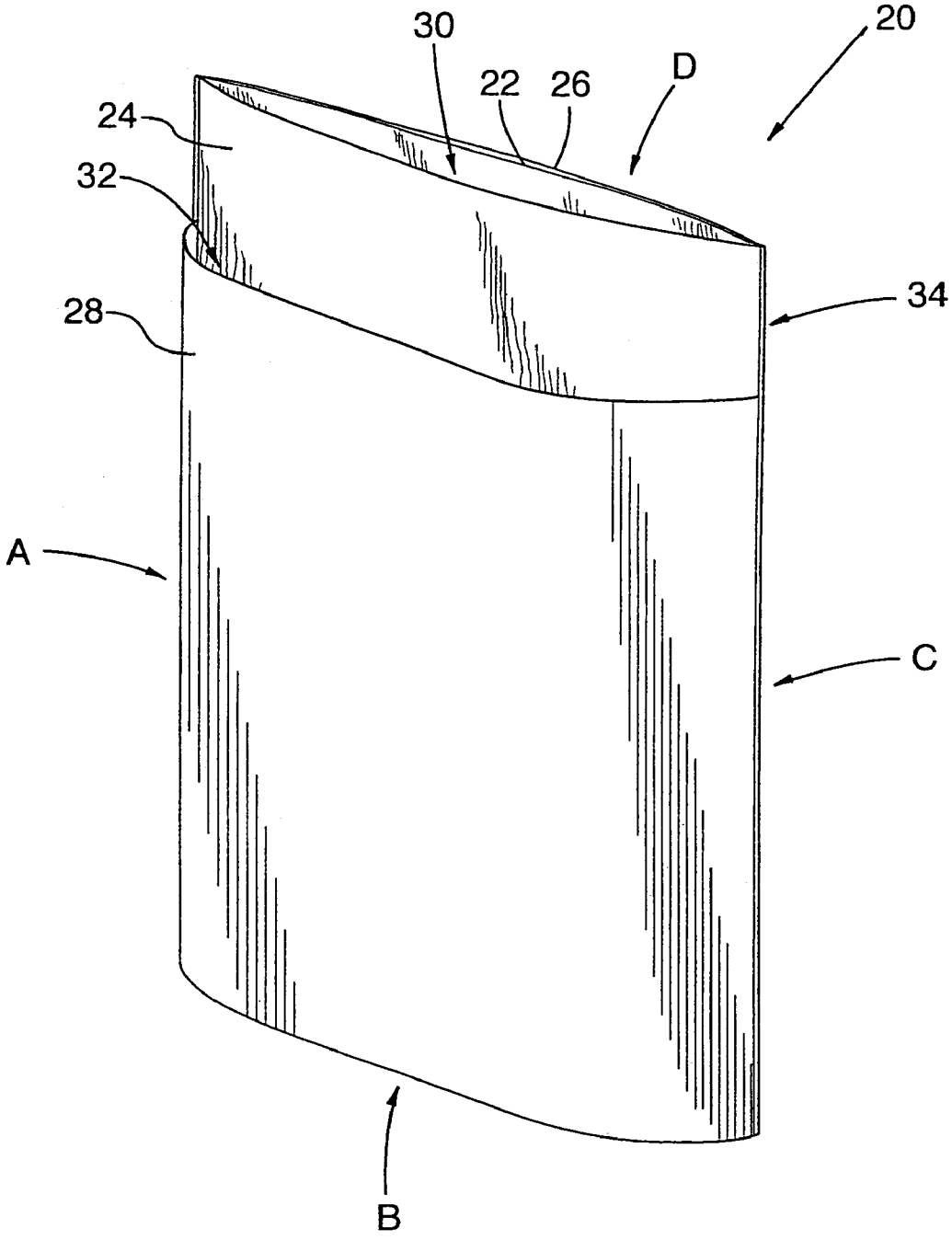
FIG. 1 is a perspective view of a bag.

The process is for use with a supply of bags 20, a respective one of which is shown in FIG. 1, which are similar to fertilizer bags of the prior art in that they are constructed from substantially rectilinear flexible panels of heat-sealable material, specifically, linear low-density polyethylene, connected to one another along three edges to form a pocket. However, whereas conventional fertilizer bags consist of two similarly-sized panels of relatively robust material, the bags used in the present invention comprise a plurality of panels 22,24,26,28, said plurality comprising a first panel 22,26, a second panel 24 and a third panel 28, the plurality being disposed in stacked relation to one another with the second panel 24 between the first panel 22,26 and the third panel 28, and connected to one another to form a first pocket 30 between the first panel 22,26 and the second panel 24 and a second pocket 32 between the second panel 24 and the third panel 28.

The first panel 22,26 has an outer layer 26 and an inner layer 22. The second panel 24 and the inner layer 22 are made out of relatively thin, lightweight thermoplastic, and are joined along three sides A,B,C, to define the lower end of the first pocket 30. The second panel 24 and the inner layer 22 are actually formed out of a sheet of relatively thin material, which is folded to define the inner layer 22 and the second panel 24. The outer layer 26 of the first panel and the third panel 28 are constructed from thicker, relatively more robust thermoplastic material, and are sandwiched outside the lightweight panels 22,24. The outer layer 26 and the third panel 28 are similarly constructed out of a sheet of relatively thick material, said sheet being folded to define the outer layer 26 and the third panel 28. The outer layer 26 is dimensioned similarly to the lightweight panels 22,24 and has its periphery A,B,C,D joined to the periphery A,B,C,D of the inner layer 22, thereby to form a two-ply sidewall of the first pocket 30. The third panel 28 of the more robust panels 26,28 is slightly smaller in one dimension than the first panel 22,26 and the second panel 24, and is connected along three sides A,B,C to the second panel 24 such that the first panel 22,26 and the second panel 24 project beyond the third panel 28, the projecting portions thereof collectively defining a flap 34. The third panel 28 and second panel 24 define the second pocket 32. Although not clearly shown, it should be understood that in the preferred embodiment, the panels 22,24,26,28 are joined to one another at B to provide a substantially flat-bottomed portion of the bag 20; this method of joinery is well known to persons of ordinary skill in the art of bag-making, and as such is not described herein in detail.

Figure 2:
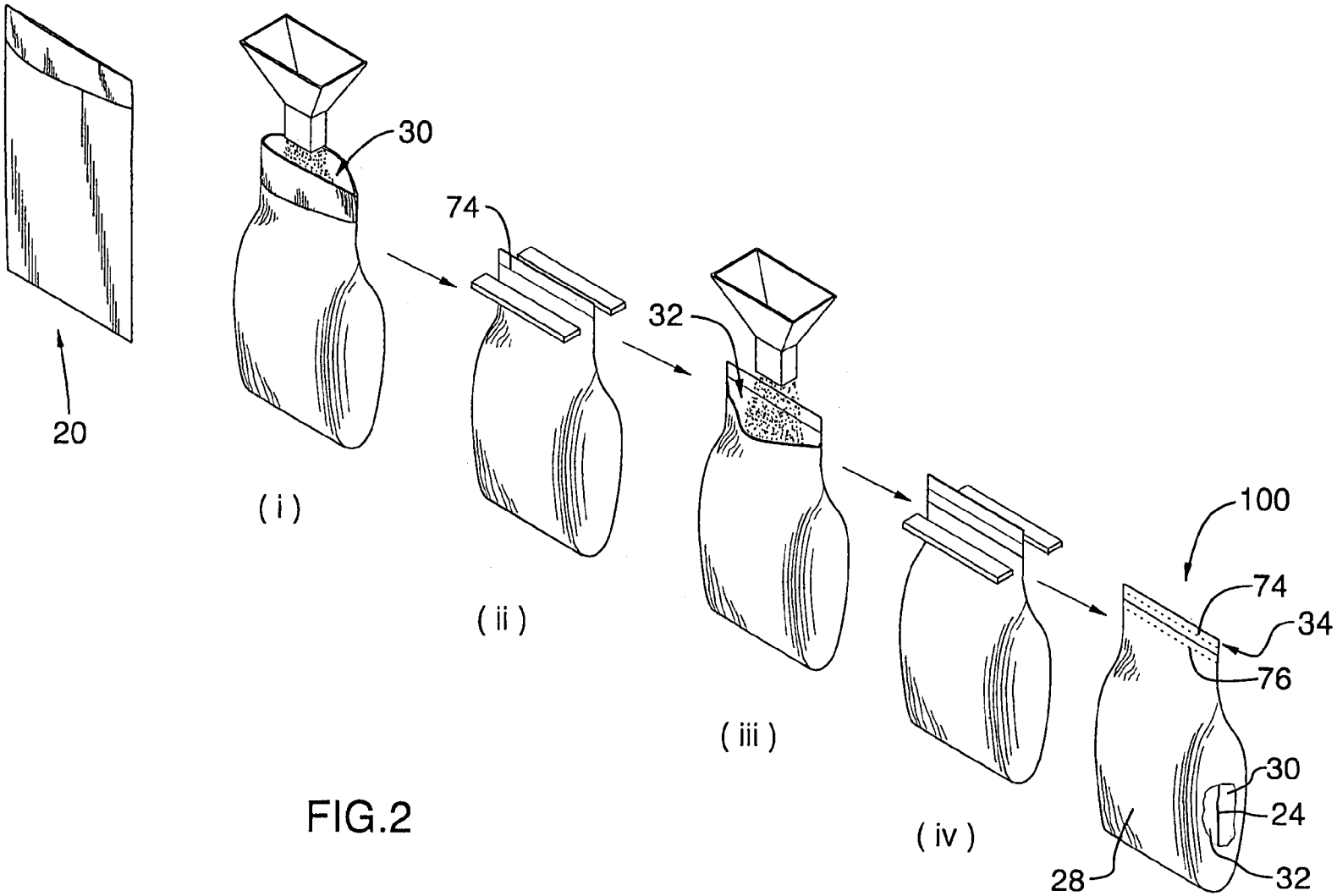
FIG. 2 is a perspective view of the bag of FIG. 1 at various stages as it passes through a preferred embodiment of a process according to the present invention.

FIG. 2 is a simplified illustration of the process according to the preferred embodiment thereof, showing the bag 20 at various stages. Generally, in the process: (i) the first granular material is introduced into the first pocket 30; (ii) the first pocket 30 is sealed shut; (iii) the second granular material is introduced into the second pocket 32; and (iv) the second pocket 32 is sealed shut.

Reference is now made to FIGS. 3-9 which show, inter alia, step (i) of the process of the preferred embodiment in more detail.

Figure 3:
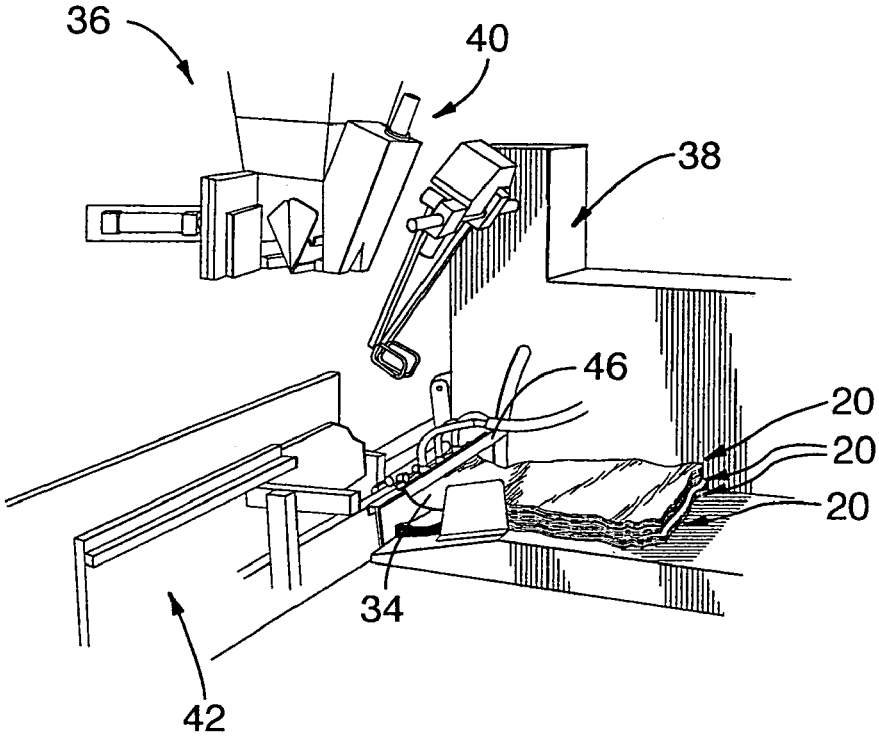
FIG. 3 is a perspective view of a stack of bags of the type shown in FIG. 1, and a series of suction cups of a bag placer drawing a bag from the stack.

In FIG. 3, a supply of bags 20 is shown, the bags 20 being stacked upon one another such that the side of each bag 20 defined by the third, relatively shorter panel (not shown) presents downwardly. Also shown in FIG. 3 is a dispensing machine 36 including a bag placer 38, a bagging scale 40 and a conveyor 42.

Figure 4:
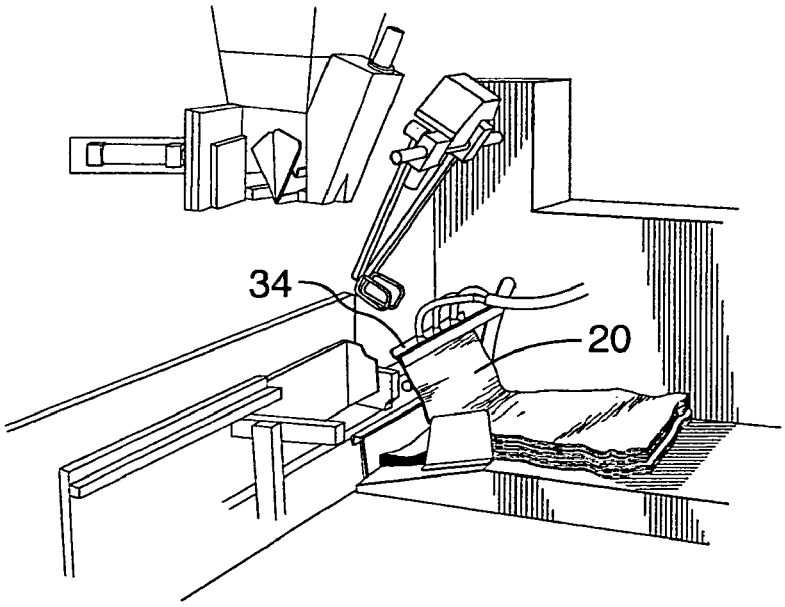
FIG. 4 is a view similar to FIG. 3, showing further suction cups of the bag placer of FIG. 3 drawing a pocket of the bag open.
Figure 5:
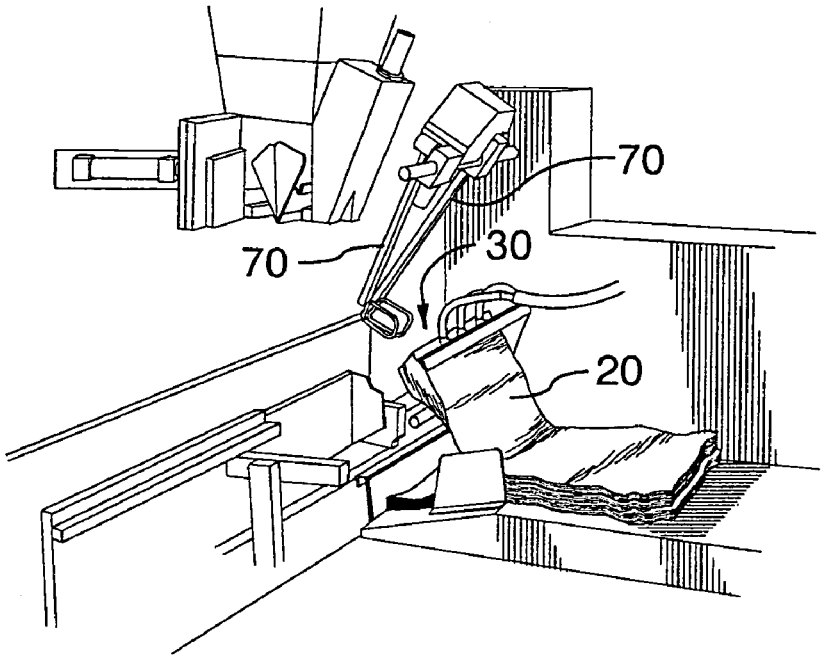
FIG. 5 is a view similar to FIG. 4, showing a pair of gripper arms of the bag placer entering the open pocket.
Figure 6:
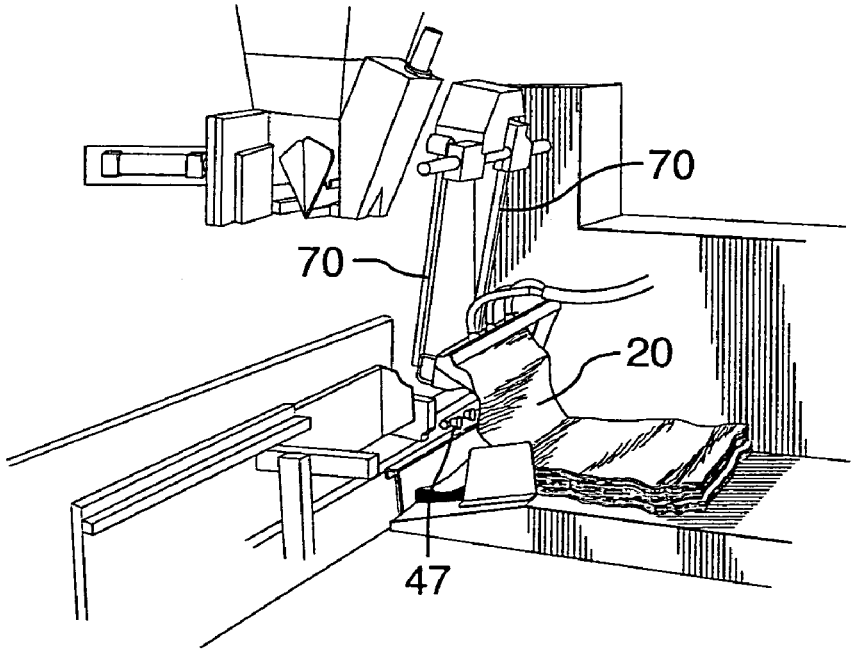
FIG. 6 is a view similar to FIG. 5, showing the gripper arms drawing apart from one another, to grip the bag.
Figure 7:
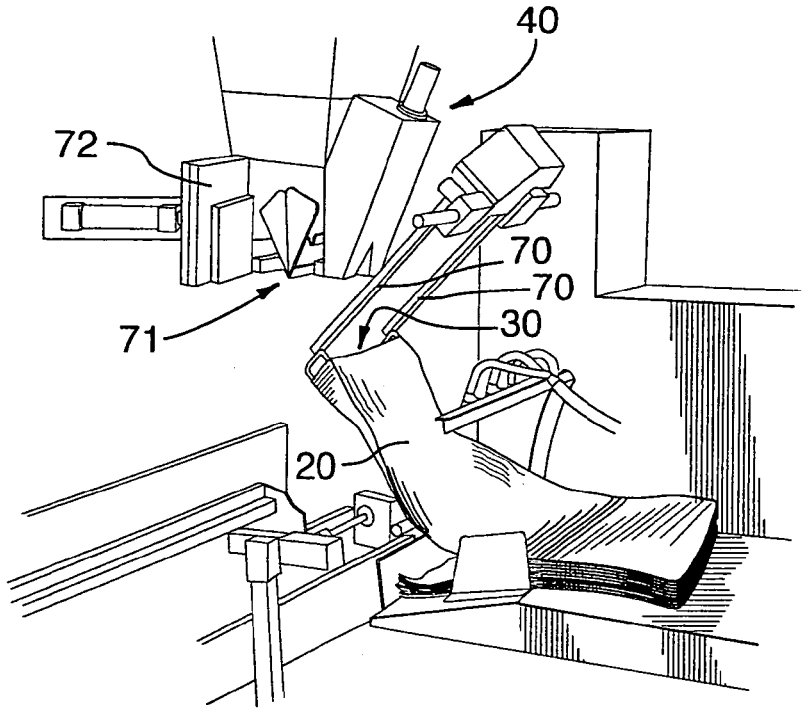
FIG. 7 is a view similar to FIG. 6, showing the gripper arms delivering the gripped bag towards the mouth of a bagging scale.
Figure 8:
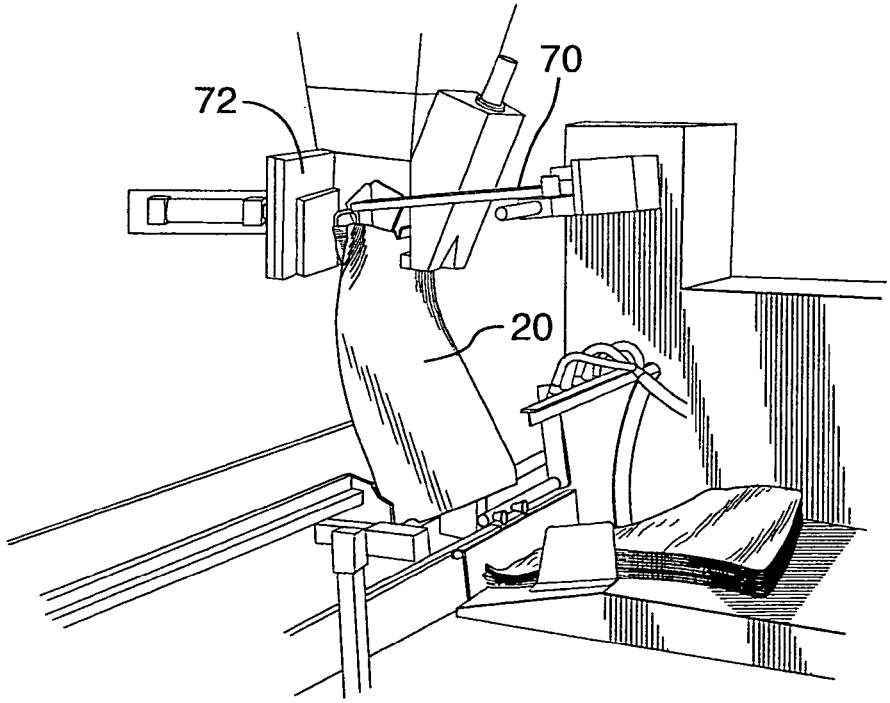
FIG. 8 is a view similar to FIG. 7, showing the bag seated around the mouth of the bagging scale.
Figure 9:
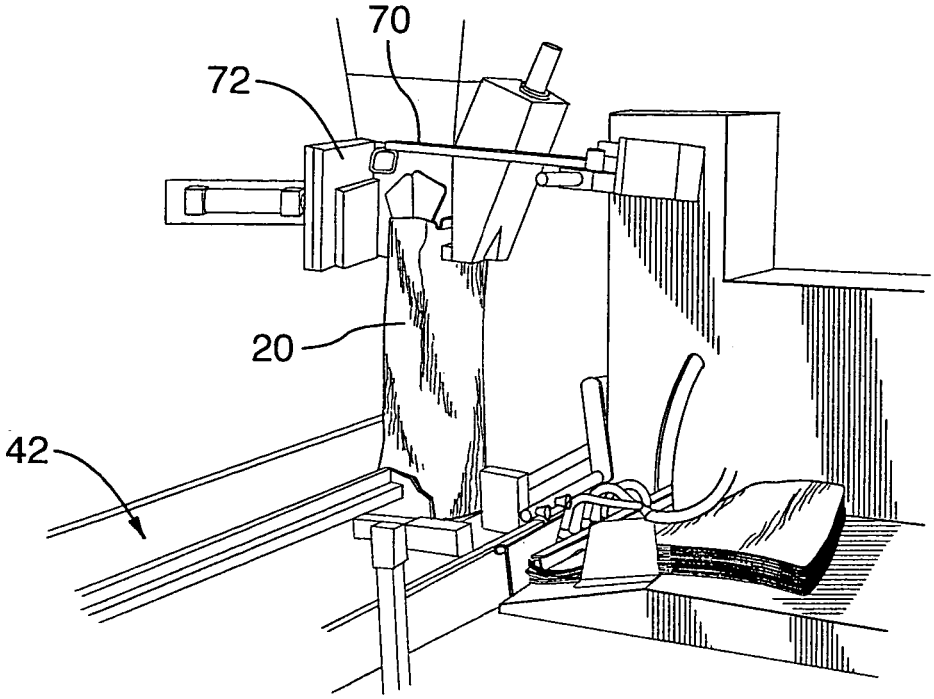
FIG. 9 is a view similar to FIG. 8, with the gripper arms withdrawn from the bag.
Figure 10:
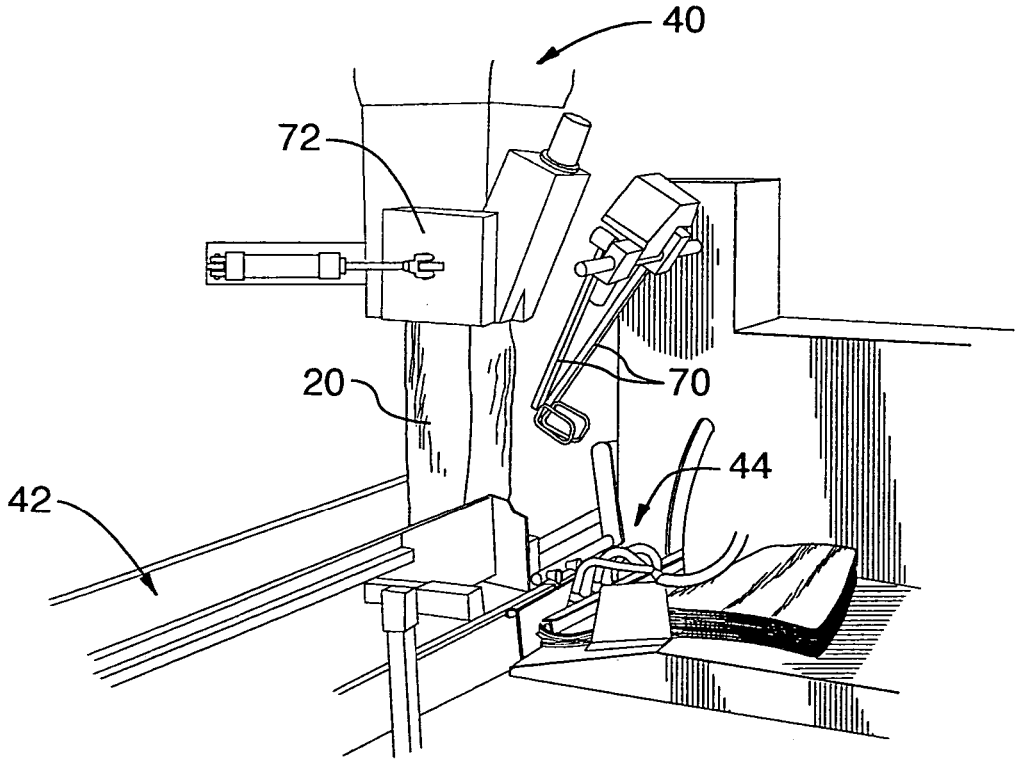
FIG. 10 is a view similar to FIG. 9, showing gripping blocks of the bagging scale engaging the sides of the bag to hold same in position around the mouth.

The bag placer 38 is of the type sold by Pacepacker Ltd., of Braintree England under the trade-mark PACEPACKER. The bag placer 38 has a robotic arm 46 provided with a first series of suction cups (not shown). The arm 46 positions the first suction cups against the upper side of the flap 34 of the uppermost bag in the stack, as shown in FIG. 3, whereupon the cups engage the flap 34 and the arm 46 repositions itself, to draw the bag from the stack. A second set of suction cups then engages the side of the flap 34 defined by the panel 24, as shown in FIG. 4, and thereafter draws away from the first cups, thereby to draw open the first pocket 30 as shown in FIG. 5. A pair of gripper arms 70 then enters the first pocket 30 and spread apart from one another, to grip the bag 20, as shown in FIG. 6, and the suction cups release as shown in the sequence of FIGS. 6,7. The second series of suction cups are shown in FIG. 6 and identified with reference numeral 47. The gripper arms 70 then deliver the bag 20 around the mouth 71 of the bagging scale 40, as shown in the sequence of FIGS. 7,8, and then withdraw, as shown in FIG. 9. Once the gripper arms 70 have withdrawn, gripping blocks 72 of the bagging scale 40 engage the sides of the bag 20 to hold same in position around the mouth, as shown in FIG. 10.

The bagging scale 40 then dispenses a target weight of first granular material into the first pocket of the bag 20.

Figure 11:
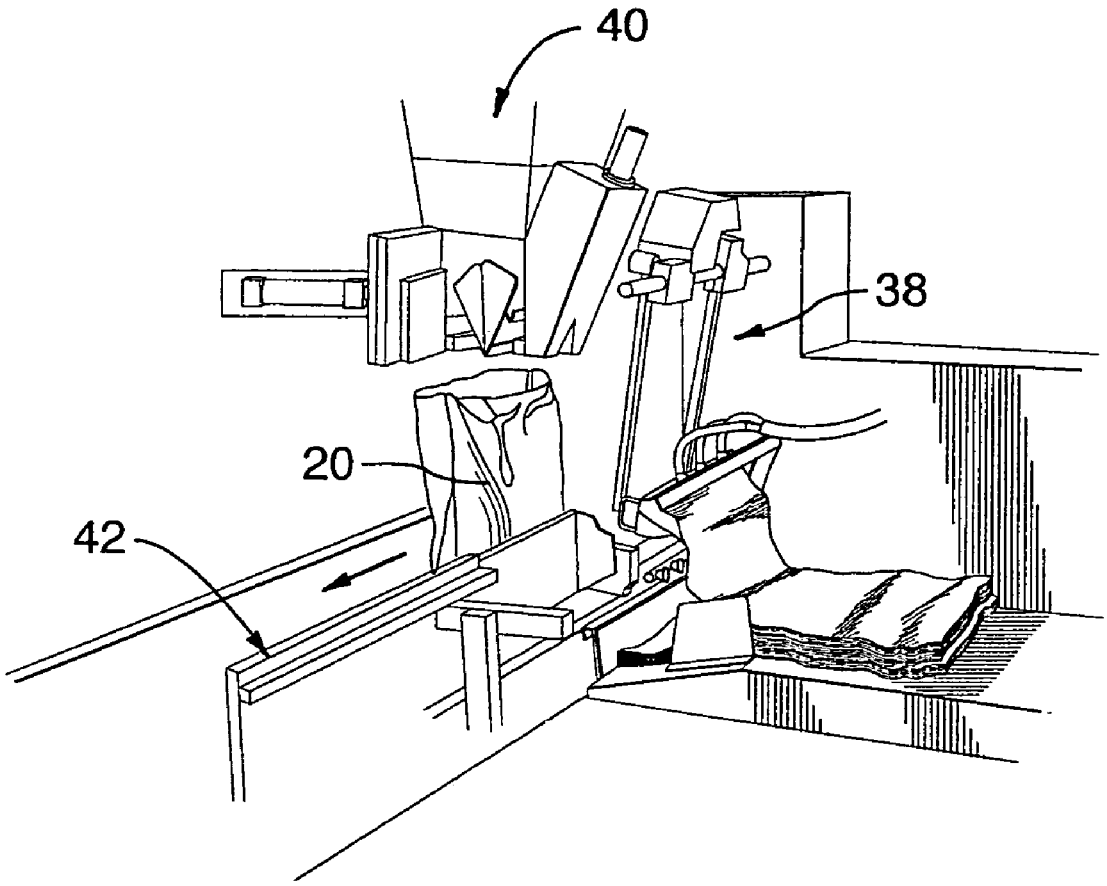
FIG. 11 is a view similar to FIG. 10, showing the gripping blocks released and the bag seated on a conveyor.

When the target weight has been reached, an elevating device 44 engages the bag bottom, the gripping blocks 72 of the bagging scale 40 release the bag 20, and the elevating device 44 lowers the bag onto the conveyor 42, as shown in FIG. 11. Thence, the bag is conveyed away from the scale 40 by the conveyor 42 and an empty bag is reinstated beneath the scale 40 by the bag placer 38 in the manner hereinbefore discussed.

Reference is now made to FIGS. 12-18, which show, inter alia, step (ii) of the preferred embodiment in more detail.

Figure 12:
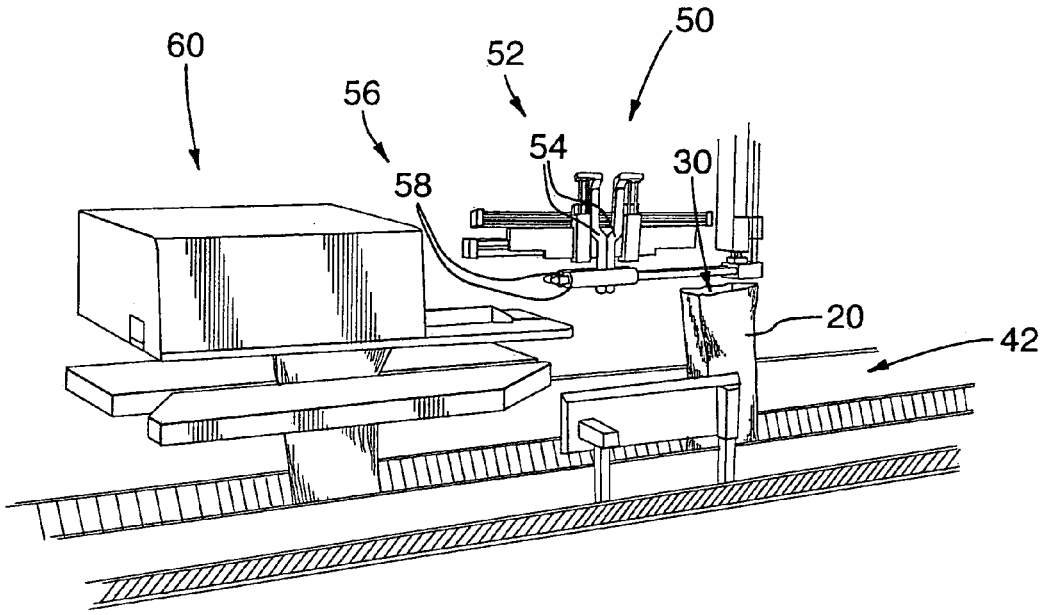
FIG. 12 is a perspective view of a bag former having reciprocating fingers disposed above the bag of FIG. 11.

FIG. 12 shows a bag-former 50, to which the conveyor 42 conveys the partially-filled bags produced by step (i).

Figure 13:
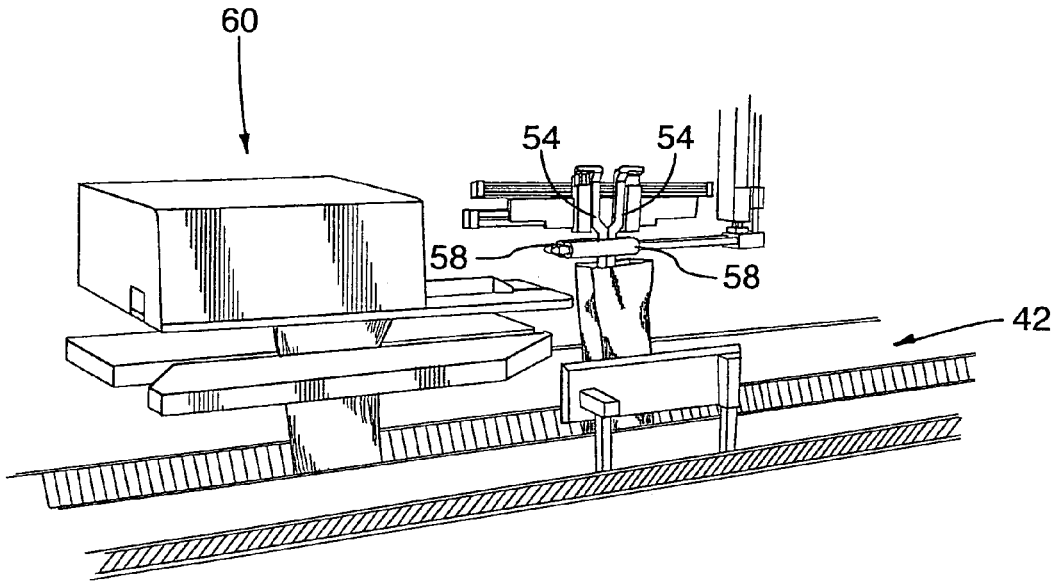
FIG. 13 is a view similar to FIG. 12, showing the reciprocating fingers lowered into the first pocket of the bag.
Figure 14:
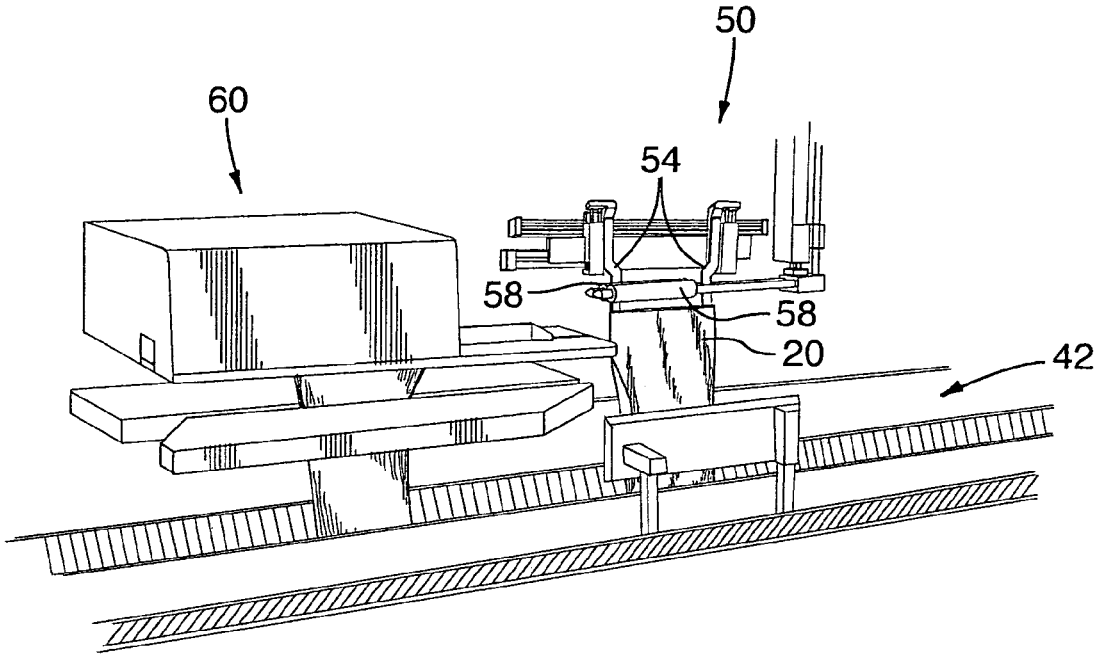
FIG. 14 is a view similar to FIG. 13, showing the reciprocating fingers drawn apart from one another, to bring the panels of the bag near one another.
Figure 15:
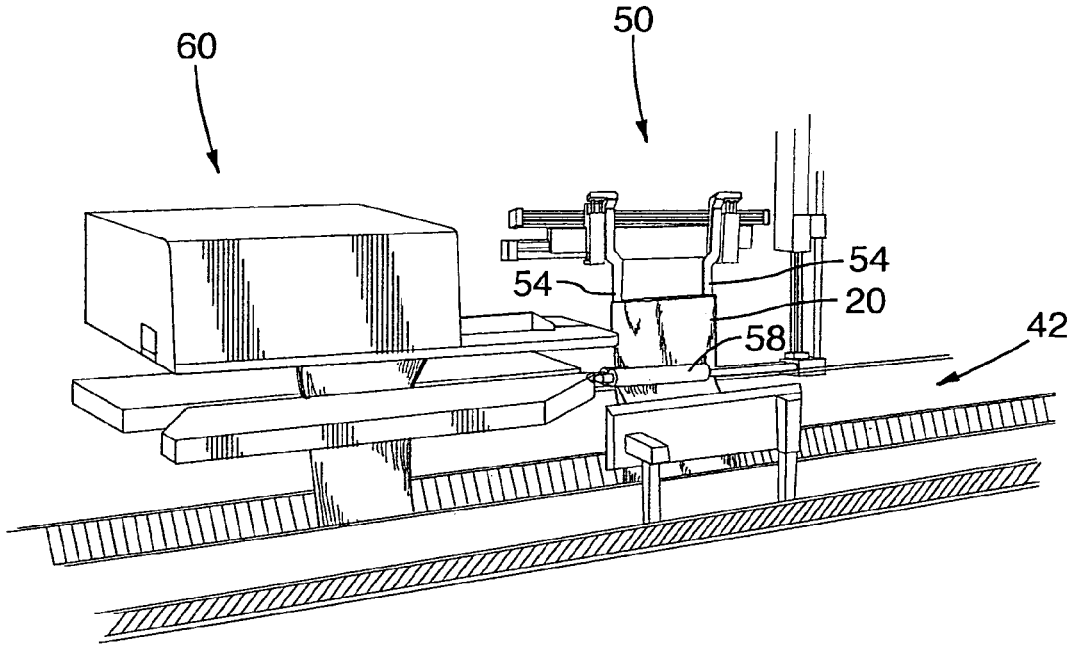
FIG. 15 is a view similar to FIG. 14, showing rollers of the bag former squeezing the panels of the bag towards one another.

The bag-former 50 includes a spreader portion 52 which has a pair of reciprocating fingers 54 and an air-removing portion 56 which has a pair of rollers 58. The fingers 54 are originally disposed relatively near to one another, above the conveyor 42, as shown in FIG. 12. As the bag is caused to pass beneath the spreader portion 52 by the conveyor 42, the fingers 54 descend into the first pocket 30 of the bag, as shown in FIG. 13, and then draw apart from one another, as shown in FIG. 14, so as to bring the panels of the bag 20 near one another. Thereafter, as shown by the sequence of FIGS. 14,15, the rollers 58, commencing from an upper terminal location on the bag, and on opposite sides thereof, traverse towards the bottom of the bag, squeezing the panels of the bag 20 towards one another in such process, so as to substantially collapse/flatten the bag (against itself and its contents) and expel air therefrom.

Figure 16:
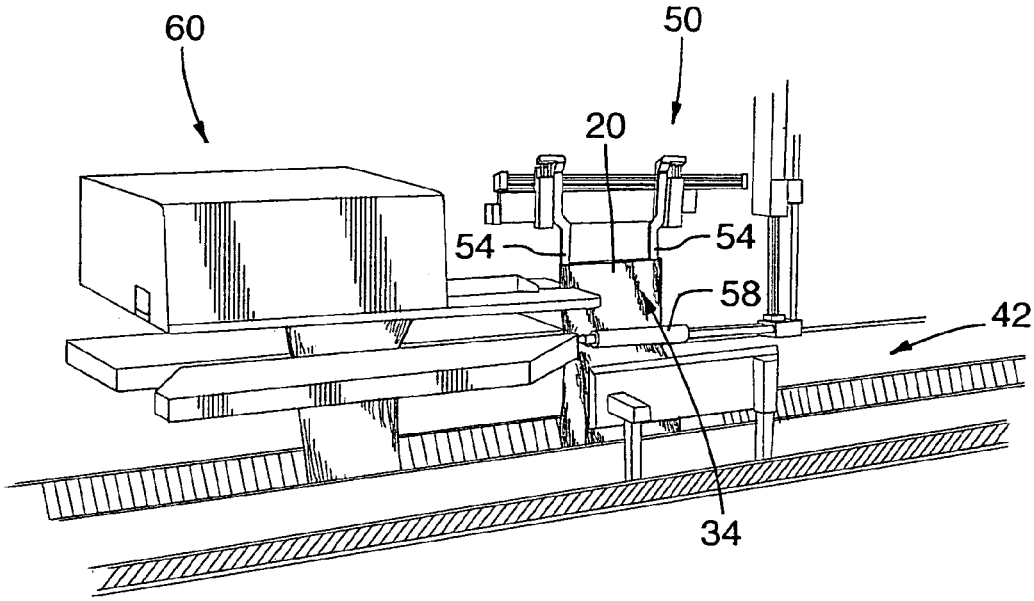
FIG. 16 is a perspective view of the flattened bag of FIG. 15 being delivered by the conveyor into the mouth of a dough-boy type heat sealer.
Figure 17:
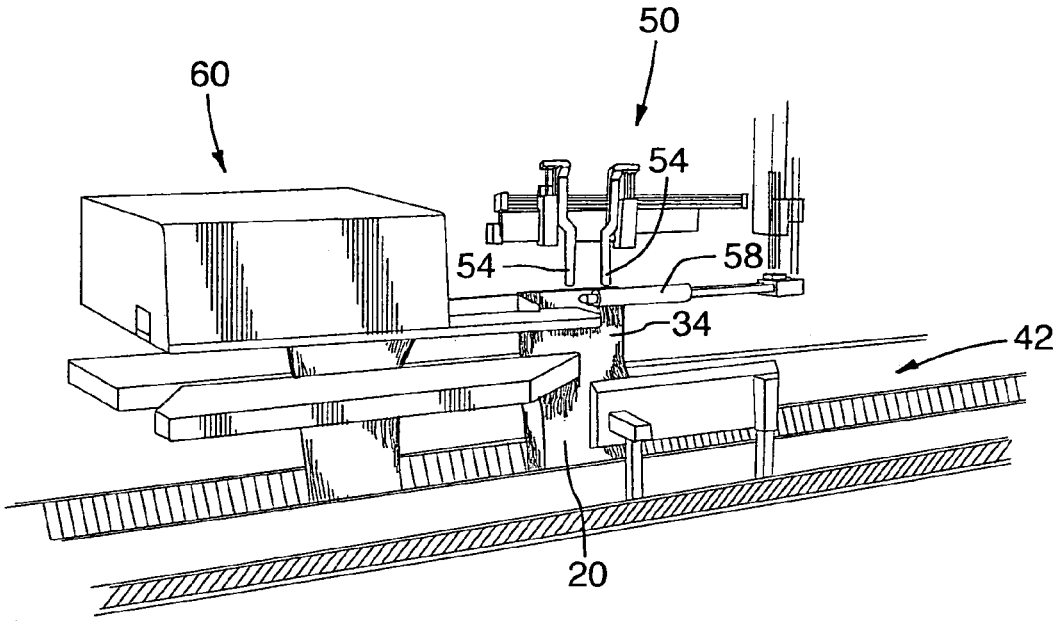
FIG. 17 is a view similar to FIG. 16, showing the reciprocating fingers withdrawn from the bag.
Figure 18:
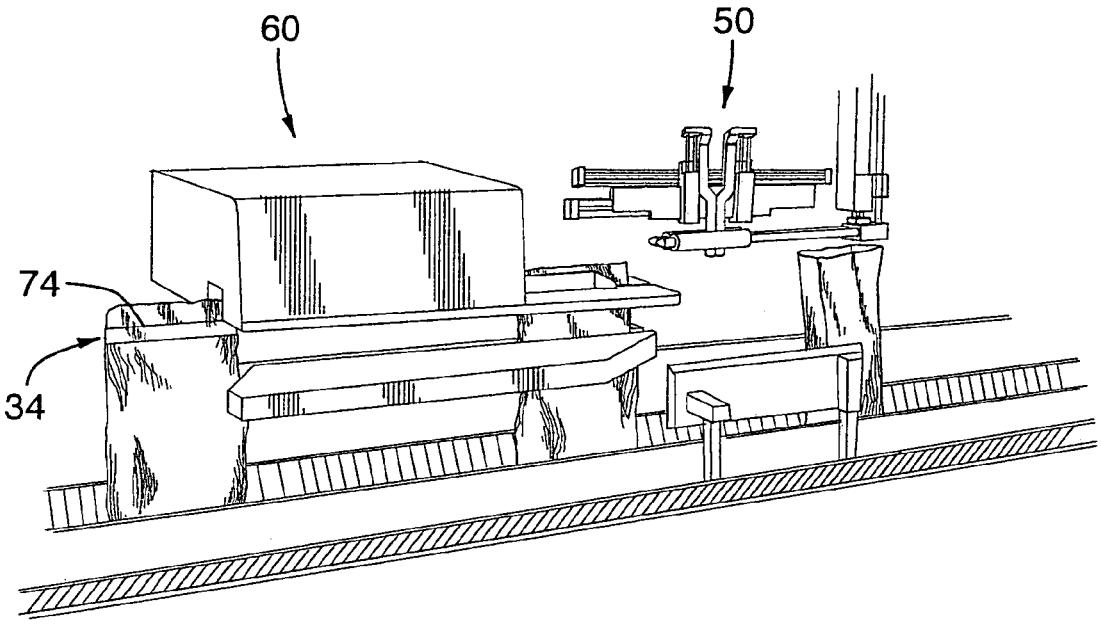
FIG. 18 shows the bag exiting the sealer.

The thus-flattened bag 20 is then released by the rollers 58, and delivered by the conveyor 42 into the mouth of a dough-boy type heat sealer 60, as shown by FIG. 16. Once the bag 20 has breached the entrance of the heat sealer 60, the fingers 54 retract from the bag 20 as shown in FIG. 17 and return to their initial position for engagement with a subsequent bag 20. In the sealer 60, the sides of the flap 34 are heat-sealed to one another along a linear joint 74 which extends across the flap 34, to seal closed the first pocket 30, as shown in FIG. 18.

Steps (iii) and (iv) can be carried out in a modified iteration (not shown) of the processes described hereinbefore, using: suction cups to drawn apart the second pocket; a hopper and scale to introduce a measured amount of the second granular material into the second pocket; a bag-former to collapse the bag and prepare the opening of the second pocket for sealing; and a "dough-boy" type heat sealer to seal the second pocket shut. Alternatively, less-automated, manual processes can be followed.

Thereafter, the completed packages can be palletized using conventional mechanisms therefore for shipment.

In the preferred embodiment, the second pocket 32 is sealed shut by heat sealing the first panel 22,26, the second panel 24 and the third panel 28 to one another along a linear joint 76 which extends across the third panel 28, along the edge of the third panel 28 which abuts the flap 34. This provides for the first pocket 30 to be sealed doubly, so as to minimize any potential for leakage.

The process provides a package having at least two sealed pockets, one 30 filled with a first granular material, preferably, a fertilizer material comprised largely of primary plant nutrients and micronutrients, another 32 filled with a second granular material, preferably, a fertilizer material comprised largely of secondary plant nutrients. The first and second granular materials are relatively storage stable and relatively unlikely to clump or cake in normal storage conditions. A completed package is shown in FIG. 2 and identified with general reference numeral 100; portions of the package are broken-away, for clarity, to reveal the pockets 30,32 and the second panel 24.

Access to the contents of the package can conveniently be obtained merely by slicing off one end thereof.

While but a single embodiment of the process and a single package produced thereby have been herein shown and described, it will be understood that various changes may be made.

For example, whereas in the preferred process, sealing of the second pocket provides a redundant seal of the first pocket, this need not be the case; the panels defining the second pocket could simply be sealed to one another. In this event, it could be advantageous to construct the second panel out of relatively more durable material than in the preferred embodiment, since second granular material would no longer need be held back from the flap area by the redundant seal.

Further, whereas the bag of the preferred embodiment is constructed of panels of LLDPE, other thermoplastics are contemplated to be useful for this purpose.

Yet further, whereas the pockets are sealed by heat-sealing in the preferred embodiment of the process, other sealing technologies, such as adhesive sealing or stitching, can be used. This permits thermoset plastics or other fabrics also to be used for the construction of the bag.

As well, whereas the disclosure contemplates the use of the process of the present invention to permit the packaging of granular fertilizers that are not storage stable when comingled, by reason of a tendency to cake or clump, it will be evident to persons of ordinary skill in the art that the process can also be advantageously used for packaging disparate granular materials that are incompatible for long-term storage when mixed for reasons other than clumping, for example, materials that might chemically degrade.

These modifications, and others, are contemplated to fall within the scope of the invention. Accordingly, the scope of the invention is to be limited only by the accompanying claims, purposively construed.

The invention claimed is:

1. A package comprising:

a plurality of flexible panels including a first panel, a second panel and a third panel, the plurality of panels being disposed in stacked relation to one another with the second panel between the first panel and the third panel, and connected to one another to form a first sealed pocket between the first panel and the second panel and a second sealed pocket between the second panel and the third panel;

a first fertilizer product disposed in the first sealed pocket; and a second fertilizer product disposed in the second sealed pocket.

2. A package according to claim 1, wherein the first fertilizer product has a relatively high concentration of phosphorus and a relatively low concentration of calcium and magnesium, and wherein the second fertilizer product has a relatively low concentration of phosphorus and a relatively high concentration of calcium and/or magnesium.

3. A package according to claim 1, wherein the first fertilizer product comprises primary plant nutrients and micronutrients and the second fertilizer product comprises secondary plant nutrients.

4. A package according to claim 1, wherein the first fertilizer product is in particulate form, the particulate being selected from grains, powders, crystals and prills.

5. A package according to claim 1, wherein the second fertilizer product is in particulate form, the particulate being selected from grains, powders, crystals and prills.

6. A package according to claim 1, wherein each of the plurality of panels are constructed out of heat-sealable material.

7. A package according to claim 6, wherein the first panel and the second panel are dimensioned similarly to one another, and wherein the third panel is slightly smaller in one dimension and connected to the second panel such that the first panel and the second panel project beyond the third panel, the projecting portions thereof collectively defining a flap.

8. A package according to claim 7, wherein the third panel is connected to the second panel about the periphery of the third panel.

9. A package according to claim 8, wherein the first panel is connected to the second panel about their respective peripheries.

10. A package according to claim 9, wherein the first panel, the second panel and the third panel are heat sealed to one another along a linear joint which extends across the third panel, along the edge of the third panel which abuts the flap.

11. A package according to claim 10, wherein the first panel comprises an outer layer of relatively thick material and an inner layer of relatively thin material.

12. A package according to claim 11, wherein the third panel is constructed from relatively thick material and wherein the second panel is formed out of relatively thin material.

13. A package according to claim 12, wherein the outer layer of the first panel and the third panel are formed out of a sheet of relatively thick material, said sheet being folded to define said outer layer and said third panel, and wherein the second panel and the inner layer of the first panel are formed out of a sheet of relatively thin material, said sheet being folded to define the second panel and the fourth panel.

14. A packaging process comprising the steps of:

providing a bag including a plurality of flexible panels including a first panel, a second panel and a third panel, the plurality of panels being disposed in stacked relation to one another with the second panel between the first panel and the third panel, and connected to one another to form a first pocket between the first panel and the second panel and a second pocket between the second panel and the third panel;

filling the first pocket with a first fertilizer product and the second pocket with a second fertilizer product; and sealing the first pocket and sealing the second pocket.

15. A process according to claim 14, wherein the second pocket is filled and sealed after the first pocket has been filled and sealed.

16. A process according to claim 15, wherein the first fertilizer product has a relatively high concentration of phosphorus and a relatively low concentration of calcium and magnesium, and wherein the second fertilizer product has a relatively low concentration of phosphorus and a relatively high concentration of calcium and/or magnesium.

17. A process according to claim 16, wherein the first panel and the second panel are dimensioned similarly to one another, and wherein the third panel is slightly smaller in one dimension than and connected to the second panel such that the first panel and the second panel project beyond the third panel, the projecting portions thereof collectively defining a flap.

18. A process according to claim 17, wherein, when the second pocket is sealed, the third panel is connected to the second panel about the periphery of the third panel.

19. A process according to claim 18, wherein, when the first pocket is sealed, the first panel is connected to the second panel about their respective peripheries.

20. A process according to claim 19, wherein, when the first pocket and the second pocket are sealed, the first panel, the second panel and the third panel are heat-sealed to one another along a linear joint which extends across the third panel, along the edge of the third panel which abuts the flap.

* * * * *